US010641003B2

(12) United States Patent
Macias

(10) Patent No.: US 10,641,003 B2
(45) Date of Patent: May 5, 2020

(54) CANOPY GUTTER SYSTEM

(71) Applicant: Phillip Andrew Macias, Chagrin Falls, OH (US)

(72) Inventor: Phillip Andrew Macias, Chagrin Falls, OH (US)

( * ) Notice: Subject to any disclaimer, the term of this patent is extended or adjusted under 35 U.S.C. 154(b) by 372 days.

(21) Appl. No.: 15/430,909

(22) Filed: Feb. 13, 2017

(65) Prior Publication Data

US 2017/0234030 A1 Aug. 17, 2017

Related U.S. Application Data

(60) Provisional application No. 62/294,079, filed on Feb. 11, 2016.

(51) Int. Cl.

| | |
|---|---|
| ***E04H 15/02*** | (2006.01) |
| ***E04H 15/18*** | (2006.01) |
| ***E04H 15/32*** | (2006.01) |
| ***E04H 15/34*** | (2006.01) |

(Continued)

(52) U.S. Cl.

CPC ..... *E04H 15/02* (2013.01); *E04H 15/18* (2013.01); *E04H 15/32* (2013.01); *E04H 15/34* (2013.01); *E04D 13/064* (2013.01); *E04D 2013/045* (2013.01)

(58) Field of Classification Search

CPC . E04D 13/04; E04D 13/0404; E04D 13/0409; E04D 13/0445; E04D 2013/045; E04D 2103/0454; E04D 13/064; E04D 13/072

See application file for complete search history.

(56) References Cited

U.S. PATENT DOCUMENTS 1,539,907 A * 6/1925 McGill ..... E04H 15/32 135/120.4
3,810,481 A * 5/1974 Nohmura ..... E04H 15/04 135/120.3

(Continued)

FOREIGN PATENT DOCUMENTS

EP 2372049 A1 * 10/2011 ..... E04H 15/58
FR 2197396 A5 * 3/1974 ..... E04D 13/0404
JP S52146917 A * 12/1977

OTHER PUBLICATIONS

English translation of JPS52146917 from espacenet.com.*

(Continued)

*Primary Examiner* — David R Dunn
*Assistant Examiner* — Danielle Jackson
(74) *Attorney, Agent, or Firm* — Tarolli, Sundheim, Covell & Tummino LLP

(57) ABSTRACT

A canopy gutter system includes a rainwater collection slot disposed on the top side of a canopy for collecting rainwater from the top side of the canopy, thereby preventing the rainwater from cascading over the sides of the canopy. The canopy gutter system further includes a rainwater gutter disposed underneath the rainwater collection slot for receiving the collected rainwater and channeling the collected rainwater away from a side of the canopy, toward a corner of the canopy. The canopy gutter system further includes a spout for transporting the channeled water from the rainwater gutter downward toward the ground along a leg of the canopy.

12 Claims, 12 Drawing Sheets

(51) Int. Cl.
*E04D 13/04* (2006.01)
*E04D 13/064* (2006.01)

(56) References Cited

U.S. PATENT DOCUMENTS

| | | | | |
|---|---|---|---|---|
| 5,035,253 | A * | 7/1991 | Bortles | E04H 15/50 135/117 |
| 5,678,359 | A * | 10/1997 | Turner | E04D 13/064 52/105 |
| 6,345,638 | B1 * | 2/2002 | Warner | E04B 7/14 135/123 |
| 7,721,746 | B2 * | 5/2010 | Yul | E04H 15/14 135/115 |
| 8,132,583 | B2 * | 3/2012 | Mowatt, Sr. | E04F 10/0603 135/117 |
| 9,714,521 | B1 * | 7/2017 | Aloumanis | E04H 15/54 |
| 2004/0255522 | A1 * | 12/2004 | Knudson | E04D 13/0459 52/11 |
| 2005/0178417 | A1 | 8/2005 | Holub | |
| 2005/0211287 | A1 * | 9/2005 | Meyer | A45B 25/18 135/115 |
| 2008/0163910 | A1 * | 7/2008 | Hollinger | A45B 25/02 135/20.1 |
| 2016/0230411 | A1 * | 8/2016 | Dyeson | E04H 15/58 |
| 2016/0258137 | A1 * | 9/2016 | Delost | E03B 3/03 |

OTHER PUBLICATIONS

English translation of EP 2372049 A1 from espacenet.com.*
TentCraft; Pop Up Tent Accessories-Rain Gutters; https://www.youtube.com/watch?v=SypajCF84xw; Published on Sep. 25, 2014; Traverse City, MI.

* cited by examiner

CANOPY GUTTER SYSTEM

CROSS-REFERENCE TO RELATED APPLICATION

This application claims priority from U.S. Patent Application Ser. No. 62/294,079 filed on Feb. 11, 2016, which is incorporated by reference herein in its entirety.

BACKGROUND

Tents and canopies are commonly available in a variety of forms and used in a variety of applications for providing temporary shelter against weather and other environmental factors. For example, tents and canopies may be used for various recreational purposes such as for camping, for small picnics or tailgating, and for parties. Tents and canopies may also be used for larger commercial applications in which multiple tents and canopies may be arranged in different configurations.

One primary purpose for using a tent or a canopy may be to prevent the people or items within or underneath the tent or canopy from getting wet when it rains outside. Thus, the tent or canopy may be designed to deflect water from falling straight down onto the people or items underneath. However, if the rain falls at an excessive rate, the tent or canopy may not be able to deflect water fast enough, in which case rainwater may accumulate or pool on the topside. This may cause damage to the fabric of the tent or canopy, or to the frame of the canopy or tent, and possibly cause the tent or canopy to collapse from under the weight of accumulating rainwater.

In addition, simply deflecting rainwater to the sides of the canopy 100, as illustrated in FIG. 1, as is common in current canopy designs, may cause water to accumulate on the ground 102 beside the canopy which may create an inconvenience for people inside the canopy when they go to exit from under the canopy. Also, the deflected water 104 running down and off to the sides of the canopy may also cause an inconvenience to people walking into and out from the canopy as they may be exposed to concentrated amounts of heavy rainwater. These concentrated amounts of heavy rainwater running down the sides of the canopy may also cause discomfort and an inconvenience to people inside the canopy as the inside of the canopy may experience extra exposure to water resulting from this running water splashing on the sides of the canopy.

Further, when exposed to excessive wind, commonly used tent and canopy designs may experience movement unless being weighed down, which may cause inconvenience to the users or occupants. Specifically, a canopy has a tendency to lift upwards as it is introduced to the wind. If the canopy rises up off the ground, then even more wind is able to collect underneath which makes the canopy even more susceptible to blowing away. In some cases, the canopy may be damaged when exposed to extreme winds.

In addition, when configuring multiple canopies in various arrangements for larger events or commercial applications, rain may fall between the gaps of the canopies, since existing canopy designs are not configured to fit flush against one another. This accumulation of rain in between canopies may further create an unpleasant and inconvenient scenario for people under the canopies.

SUMMARY

A canopy gutter system includes a rainwater collection slot disposed on the top side of a canopy for collecting rainwater from the top side of the canopy, thereby preventing the rainwater from cascading over the sides of the canopy. The canopy gutter system further includes a rainwater gutter disposed underneath the rainwater collection slot for receiving the collected rainwater and channeling the collected rainwater away from a side of the canopy, toward a corner of the canopy. The canopy gutter system further includes a spout for transporting the channeled water from the rainwater gutter, downward toward the ground along a leg of the canopy.

BRIEF DESCRIPTION OF THE DRAWINGS

In the accompanying drawings, structures are illustrated that, together with the detailed description provided below, describe exemplary embodiments of the claimed invention. Like elements are identified with the same reference numerals. It should be understood that elements shown as a single component may be replaced with multiple components, and elements shown as multiple components may be replaced with a single component. The drawings are not to scale and the proportion of certain elements may be exaggerated for the purpose of illustration.

DETAILED DESCRIPTION

Described herein is an improved canopy design for preventing the canopy from being damaged by excessive rain and for preventing the inconveniences and potential damage caused by rainwater being deflected off the sides of a canopy. It should be appreciated that although the examples described herein make reference to a canopy, similar designs may be incorporated into a tent or other suitable similar types of temporary structures designed to offer protection against weather elements. It should further be appreciated that the examples described herein may be incorporated into canopies or tents of any suitable shape or size, including a square-shaped canopy, a rectangular-shaped canopy, a commercial size canopy, a canopy for tailgating, and so on.

Figure 1:
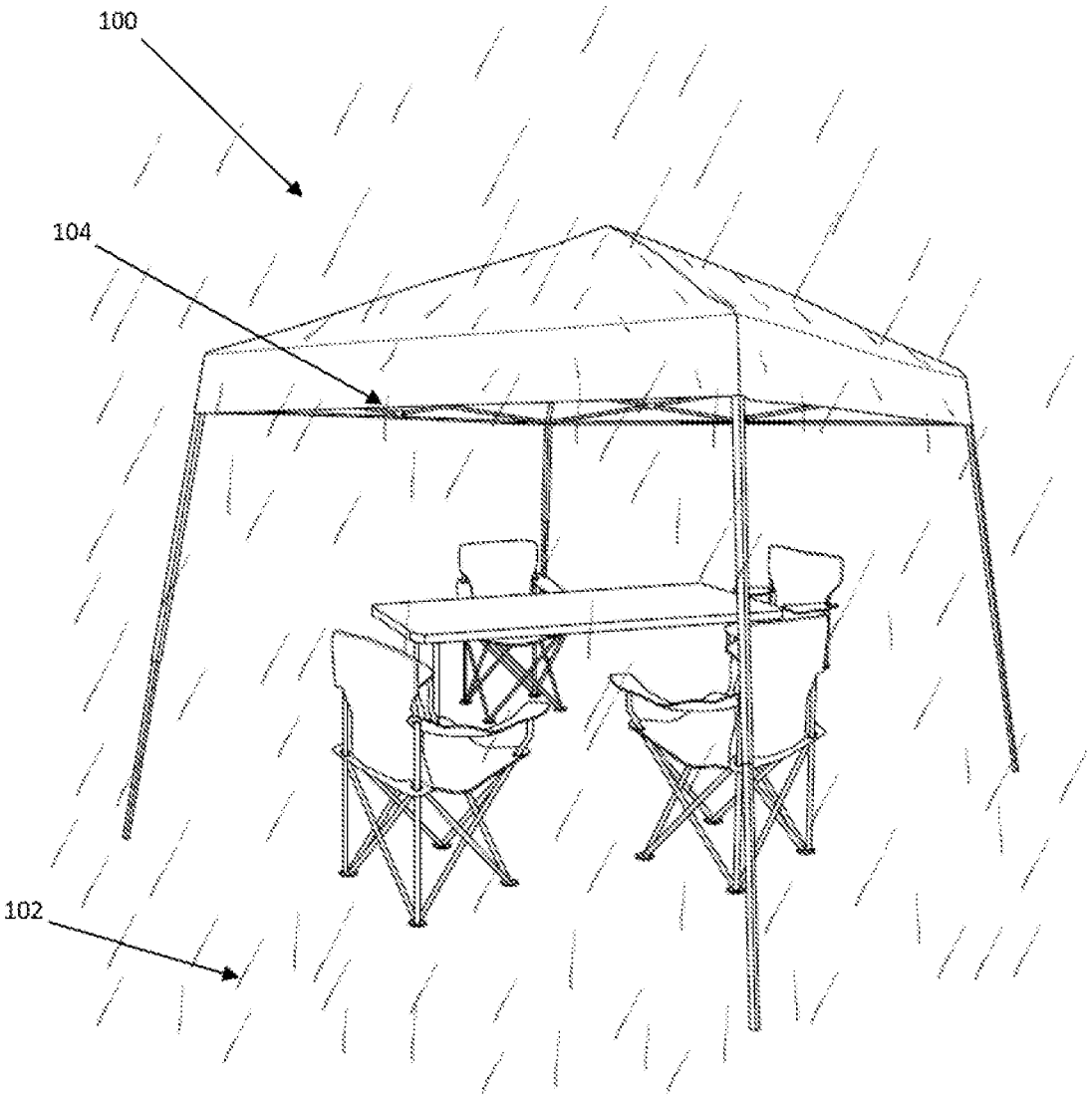
FIG. 1 illustrates an example known canopy deflecting rainwater to the sides of the canopy.
Figure 2:
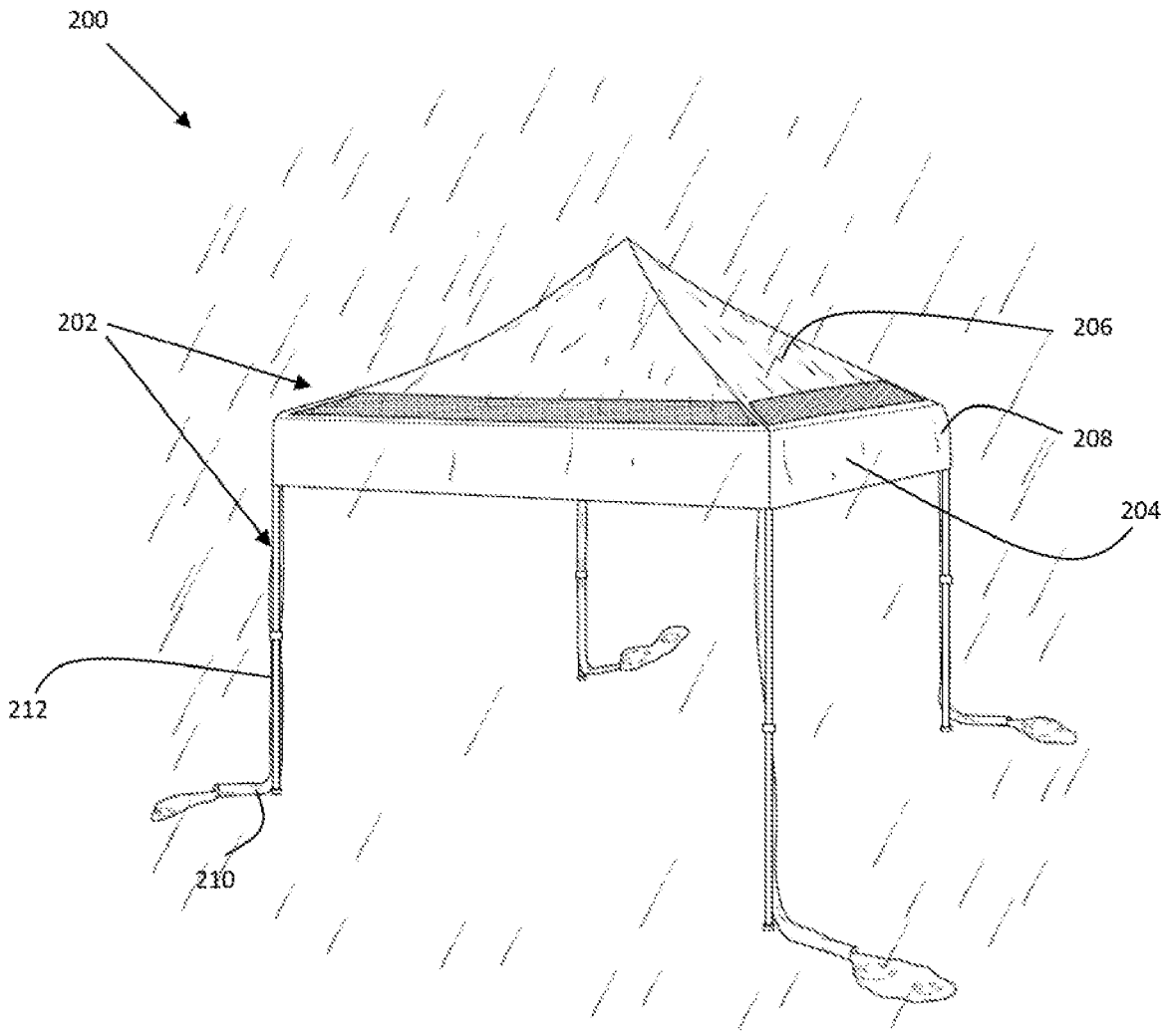
FIG. 2 illustrates an example canopy with a gutter system.

FIG. 2 illustrates an example canopy 200 including a gutter system 202 for preventing the inconveniences and potential damage caused by rainwater being deflected off the sides 204 of the canopy 200. Instead, the gutter system 202 enables the rainwater to be collected as it is drained down the rooftop 206 and channeled to a corner 208 of the canopy 200. As the rainwater flows through the gutter system 202 towards the corner 208, the water is funneled through a spout 210 towards the floor along a leg 212 of the tent 200.

Figure 3:
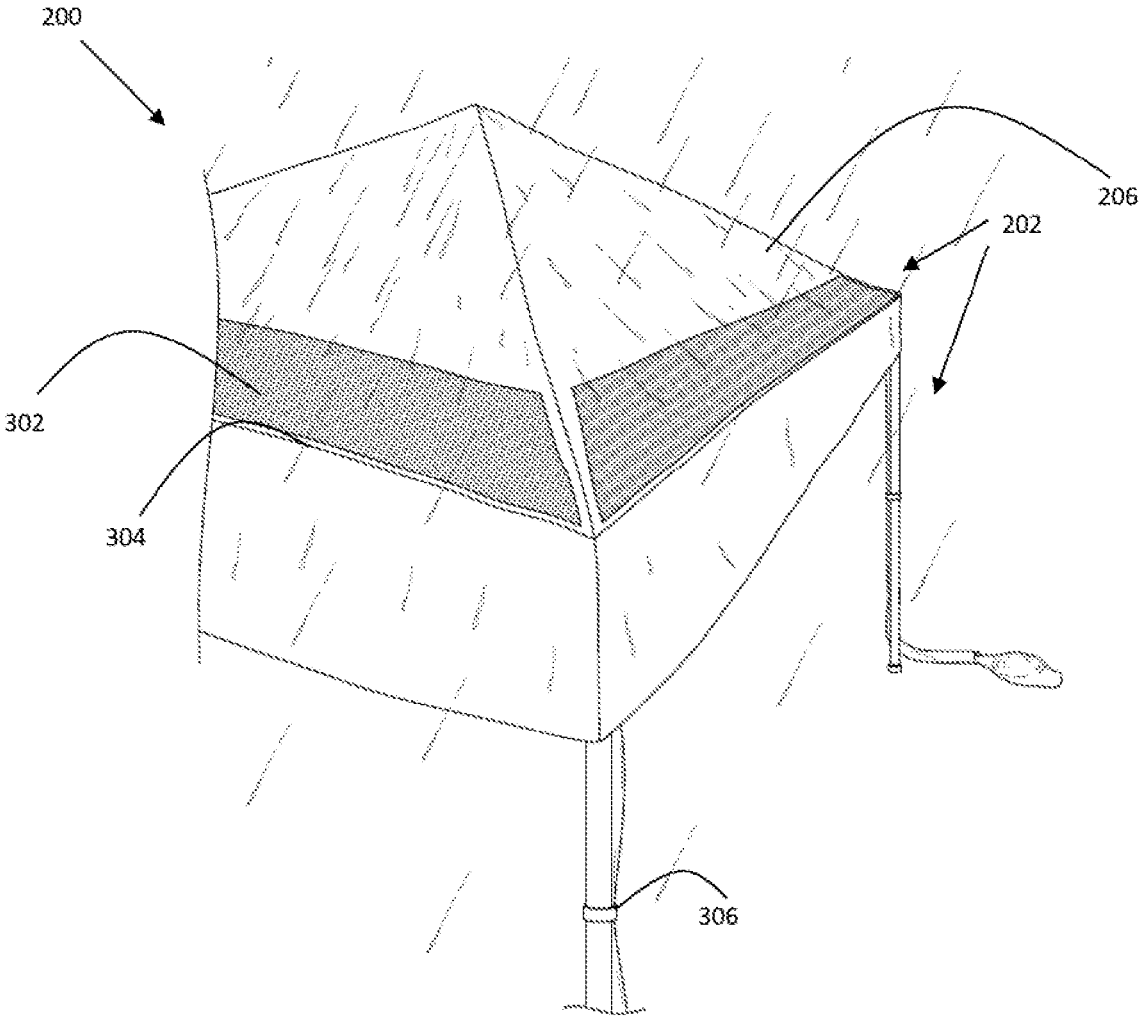
FIG. 3 illustrates a close-up view of an example canopy with a gutter system.

FIG. 3 illustrates a close-up view of the gutter system 202 of the canopy 200. The gutter system 202 includes one or more rainwater collection slots 302 in the rooftop 206 of the canopy that enable rainwater to pass through the rooftop 206 prior to reaching the side edge 304 and therefore preventing the rainwater from collecting on the topside of the rooftop 206 or from spilling over the side edges 304 in heavy concentrated form. In one example, the rainwater collection slots 302 may include a mesh material or other suitable material to filter larger debris such as leaves and dirt and only allow rainwater to enter the gutter system 202.

It should be appreciated that, although the example gutter system 202 of the example canopy 200 includes four (4) rain collection slots 302, one (1) along each side edge 304, (two [2] are not shown), the example gutter system 202 may include any suitable number of rainwater collection slots 302 disposed in any suitable arrangements. Further, although the example rainwater collection slots 302 are illustrated as having a rectangular shape substantially the length of the canopy 200, example rain collection slots 302 may include any suitable size or shape rainwater collection slots 302.

Figure 4:
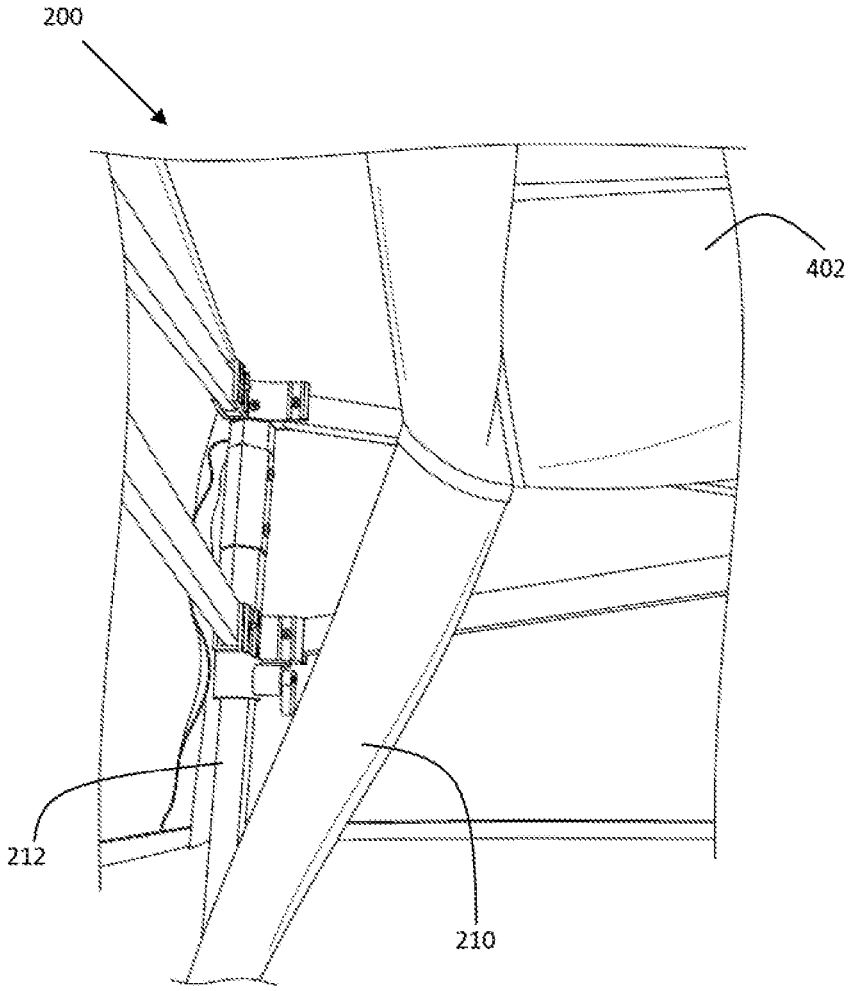
FIG. 4 illustrates a close-up view of an example canopy with a gutter system.

The example gutter system 202 further includes rainwater gutters 402 for collecting the rainwater as the rainwater runs down the rooftop 206 and into the collection slots 302, as illustrated in FIG. 4 which depicts a corner underside of the canopy 200. In one example, the gutter system 202 includes four (4) rainwater gutters 402 corresponding to the size and shape of four (4) rain collection slots 302 and disposed directly under the four (4) rain collection slots 302 respectively. It should be appreciated that any suitable number, size, and shape water gutters 402 may be used.

The gutters 402 may include any suitable material for collecting and channeling rainwater but also flexible and capable of being folded up. In one example, the gutters 402 may include the same material as that of the rooftop 206 of the canopy 200. In one example, the bottoms of the gutters 402 are angled such that collected water is funneled towards the spout 210 along the leg of the canopy 200. In one example, a first half the length of a gutter 402 may be angled such that collected water is funneled towards a first spout 210 while a second half of the length of the gutter 402 may be angled such that collected water is funneled towards a second spout 210 on the opposite end of the gutter 402.

Referring again to FIG. 3, the gutter system 202 further includes one or more fasteners 306 for securing the spout 210 to the leg 212. It should be appreciated that fasteners can include any permanent or temporary suitable fastener for securing the spout 210 to the leg 212, such as a tie string, Velcro fastener, and adhesive, and so on.

It should be appreciated that the gutter system 202 may include any suitable number of spouts 210. For example, a gutter system 202 may include a spout 210 corresponding to each leg 212 of a canopy 202. Thus, a gutter system 202 on a canopy with four (4) legs 212 may include four (4) spouts 210. In another example, a gutter system 202 may include enough spouts 210 to correspond to a subset of the legs 212. For example, a gutter system 202 may include two (2) spouts 210, each attached to alternating legs 212 on a canopy 200 that includes four (4) legs 212. It should be further appreciated that the spouts 210 may include any suitable material for receiving rainwater and directing the flow or the rainwater down along the legs 212 and away from the sides of the canopy 600 while still maintaining flexibility and for being folded up.

It should be appreciated that the spout 210 can have any suitable length. For example, the spout 210 may end at the bottom of the leg 212 and allow the collected rainwater to discharge freely into the ground near the leg 212. In another example, the spout 210 may extend down towards the ground near the leg 212 and further extend along the ground away from the leg 212 in order to channel the collected rainwater to some distance beyond the canopy 200.

In one example, the canopy 200 including the gutter system 202 is collapsible and foldable, allowing for easy transport.

Figure 5:
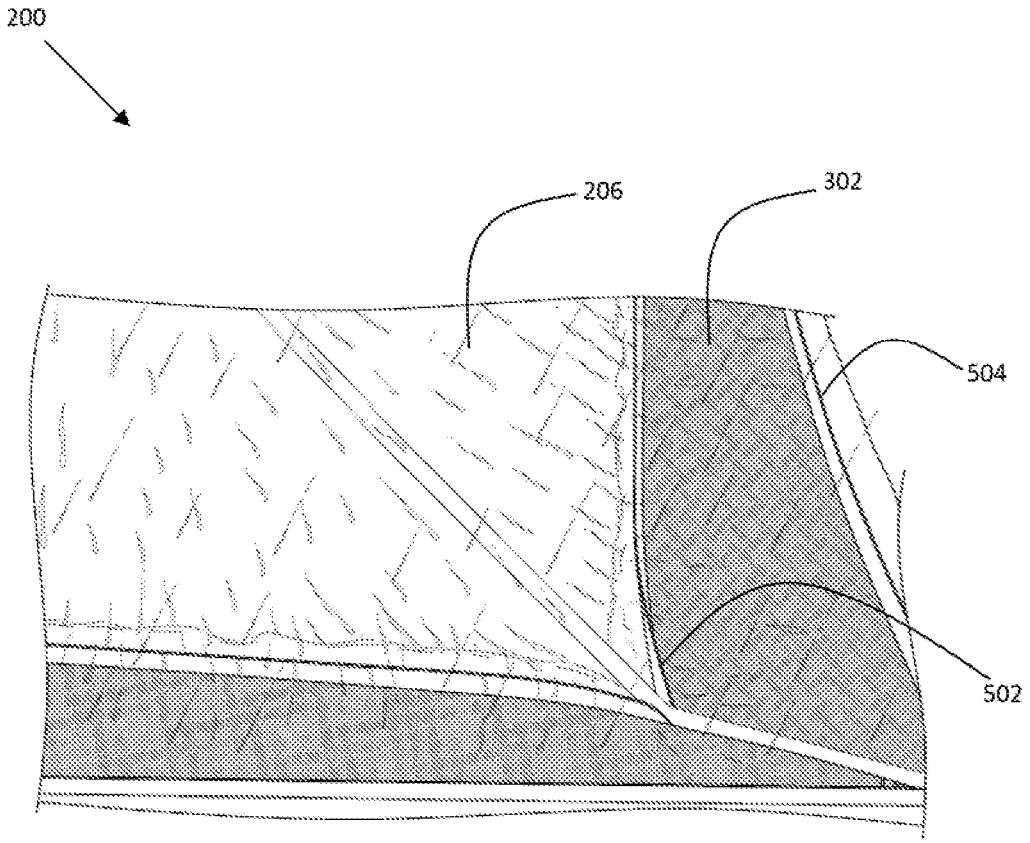
FIG. 5 illustrates a close-up view of an example canopy with a gutter system.

In one example, the gutter system 202 further includes an inner storm block 502 and an outer storm block 504, as illustrated in FIG. 5. By acting as an impediment, the storm blocks 502 and 504 reduce the velocity of rainwater as it flows down the rooftop 206 of the canopy 200. The storm blocks 502 and 504 collectively decelerate the rainwater to the point the flowing water no longer possesses the requisite velocity to traverse past the collection slots 302. The water is forced to penetrate the mesh collection slots 302 so that it is captured by the gutter 402 located at the underside of the canopy 200 and is eventually directed to the spouts 210 that run down the leg 212 of the canopy 200 to the ground.

It should be appreciated that the storm blocks 502 and 504 do not "seal" the canopy 200. In other words, the storm blocks 502 and 504 are not designed to completely barricade water. Rather, the storm blocks 502 and 504 are designed to impede the flow of rainwater and reduce its velocity as is traverses down the slope of the canopy rooftop 206.

The storm blocks 502 and 504 are installed on each side of the canopy 200 and they run parallel to each other along the entire length of the canopy 200 side. The outer storm block 504 is positioned along the outer periphery and spans the edge of the canopy 200. The inner storm block 502 is positioned a distance inwards slightly offset from the outer storm block 504. In one example, the inner storm block 502 is positioned approximately 12" towards the center of the canopy 200. The storm blocks 502 and 504 are positioned such that the rainwater collection slots 302 run in between and parallel to the storm blocks 502 and 504. In other words, the storm blocks 502 and 504 are located adjacent to each side of the rainwater collection slots 302. In one example, the storm blocks 502 and 504 span the entire length of the canopy.

It should be appreciated that the storm blocks 502 and 504 may be any suitable height for slowing down the rain flow. In one example, the storm blocks 502 and 504 are one inch (1") in height. It should be further appreciated that the storm blocks 502 and 504 may be made of any suitable material for slowing down the rain flow. In one example, the storm blocks 502 and 504 are made of reinforced polyester.

In order to slow down or decelerate the rainwater, the inner storm block 502 is the primary impediment that does the majority of the work reducing the velocity of the water. Rainwater is forced to hurdle the inner storm block 502 as is slides down the rooftop 206, thus reducing the water's kinetic energy and ultimately its velocity. The outer storm block 504 acts as a wall and a final backstop to prevent rainwater that has yet to penetrate the gutter 302 from cascading over the sides of the canopy 200.

It should be appreciated that, absent the presence of the storm blocks 502 and 504, only a portion of the rainwater flowing down the canopy rooftop 206 may penetrate the gutter 302. The remaining water would be able to traverse past the gutter 302 without penetrating it. This water may then be free to cascade over the sides of the canopy 206. It should be appreciated that the example canopy 200 is illustrated as including two (2) storm blocks, a canopy 200 may include one (1) or more than two (2) storm blocks.

Figure 6:
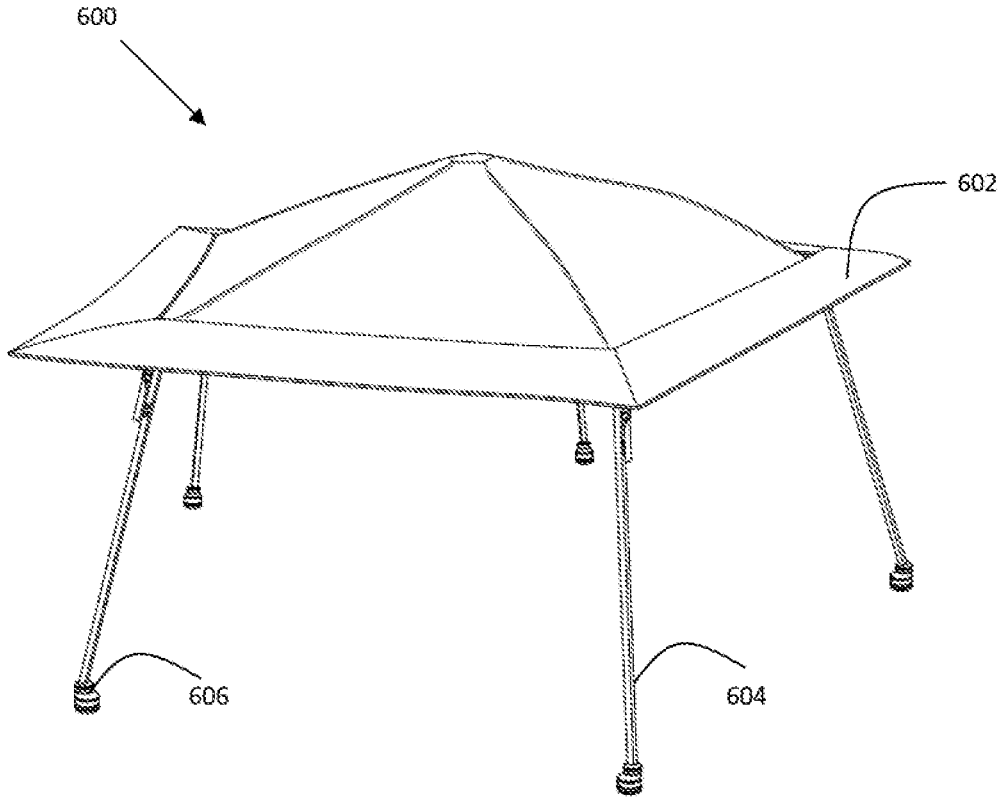
FIG. 6 illustrates an example canopy with an air stabilization system.

In one example, a canopy may further include features for preventing the canopy from moving or blowing away during high wind situations. FIG. 6 illustrates an example canopy 600 including airfoils 62 for stabilizing the canopy 600 and preventing the canopy 600 from blowing away during high wind situations. The airfoils 602 are positioned upside down around the sides of the canopy 600. The airfoils 602 use wind to generate a downward force as wind passes over top of the airfoils 602 and the canopy 600.

It should be appreciated that, even if the airfoils 602 don't generate enough downward lift to permanently pin the canopy 600 to the ground, the airfoils 602 may still generate enough downward lift to push the canopy 600 down and to prevent wind from temporarily lifting the canopy 600 off the ground, thus minimizing the opportunity for more wind to move underneath the canopy 600 and potentially blow the canopy 600 away.

The airfoils 602 can be made of any suitable fabric or material. In particular, the airfoils 602 use gravity to shape the fabric into an airfoil design capable of generating downward lift. The airfoils 602 are coupled to removable brackets (not shown) using any suitable means such as Velcro, a pull-tie, an adhesive, and so on.

Figure 7:
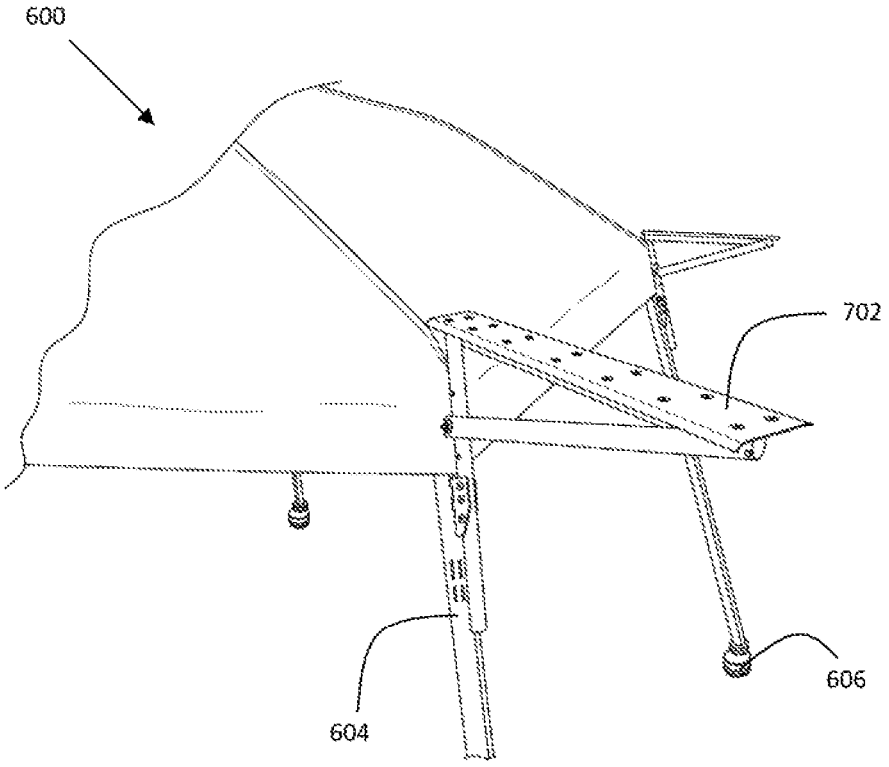
FIG. 7 illustrates a close-up view of an example canopy with an air stabilization system.

In one example, the downward force created by the airfoils 602 is transmitted to removable brackets 702, as illustrated in FIG. 7, installed on the upper portion of the legs 604 of the frame which prevents the canopy 600 from surging upwards when the wind is blowing. It should be appreciated that the brackets 702 may be installed on the canopy legs 604 using any suitable installation method.

In the case of an extreme wind condition, the wind may be sufficiently strong enough to temporarily lift the canopy 600 off the ground. However, the airfoils 602 are designed to immediately push the canopy 600 back to the ground. Thus, in one example, to prevent the canopy 600 from sliding laterally during this temporary lift, the canopy 600 further includes friction boots 606 installed on the base of the legs 604.

Figure 8:
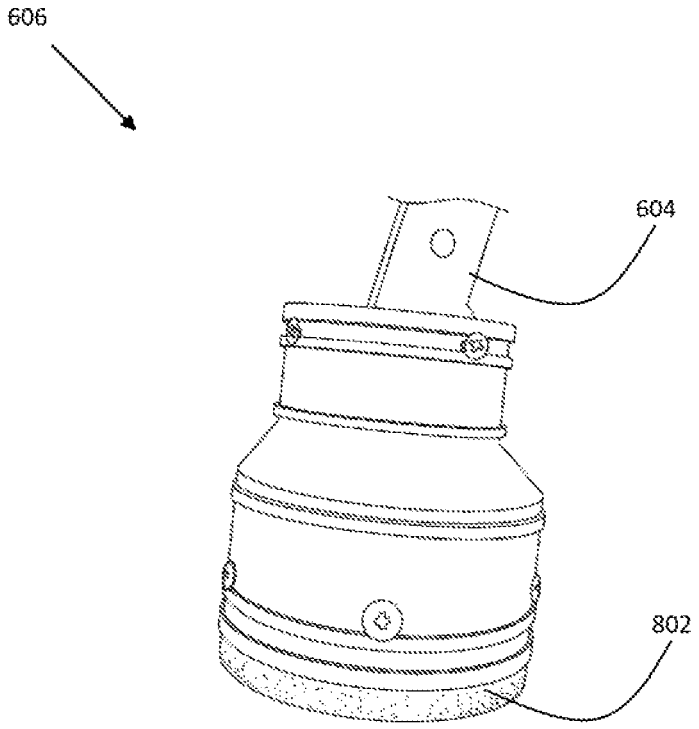
FIG. 8 illustrates an example friction boot of FIG. 7.

Friction boots 606 installed at the base of each leg 604 make it much more difficult for the canopy 600 to slide laterally. Each friction boot 606 includes a rubber pad 802 at the bottom that increases the coefficient of sliding friction between the ground and the friction boot 606, as illustrated in FIG. 8. The total downward force used to create the overall friction the boots 606 generate is the sum of the gravitational force created by the weight of the canopy 600 and the amount of downward lift generated by the upside down airfoils 602. With a boot 606 installed at the base of each leg 604, it takes a greater external force (or more wind) to move the canopy 600 or to slide it in the lateral direction.

Referring again to FIG. 6, an example canopy 600 includes five (5) legs 604. By using five (5) legs 604, the cross-sectional area of canopy fabric used is reduced, which in turn reduces the amount of wind captured by the canopy 600. Less wind being captured by the fabric results in the canopy 600 being less likely to be lifted or blown away by wind. It should be appreciated that even with a reduced cross-sectional area, the canopy 600 may still provide the same square footage of shelter coverage. It should be further appreciated that a five-leg canopy 600 design results in a canopy with five (5) sides, which makes it more difficult for the wind to meet the canopy 600 at a direct perpendicular angle. This further improves the canopy's 600 ability to withstand wind and reduces the likelihood of being dragged laterally.

It should be appreciated that the example gutter system and air stabilization system features described can be incorporated into a tent or canopy design and directly built or manufactured into the tent or canopy. Alternatively, the example gutter system and air stabilization system features described can be designed to be removable and attachable to existing tent and canopy designs. Thus, existing tents and canopies may be retrofitted with the described gutter system or the air stabilization system.

It should be appreciated that a distinguishing feature of the example gutter system described herein is to keep users dry while maintaining the structural integrity of the canopy frame, even during the heaviest of rainstorms. In particular, rain that descends onto the canopy travels down the slope of the fabric where it penetrates the mesh and is captured by the gutter system underneath. Water is funneled to the corner downspouts where it is channeled to the ground and away from the foundation of the canopy.

Figure 9:
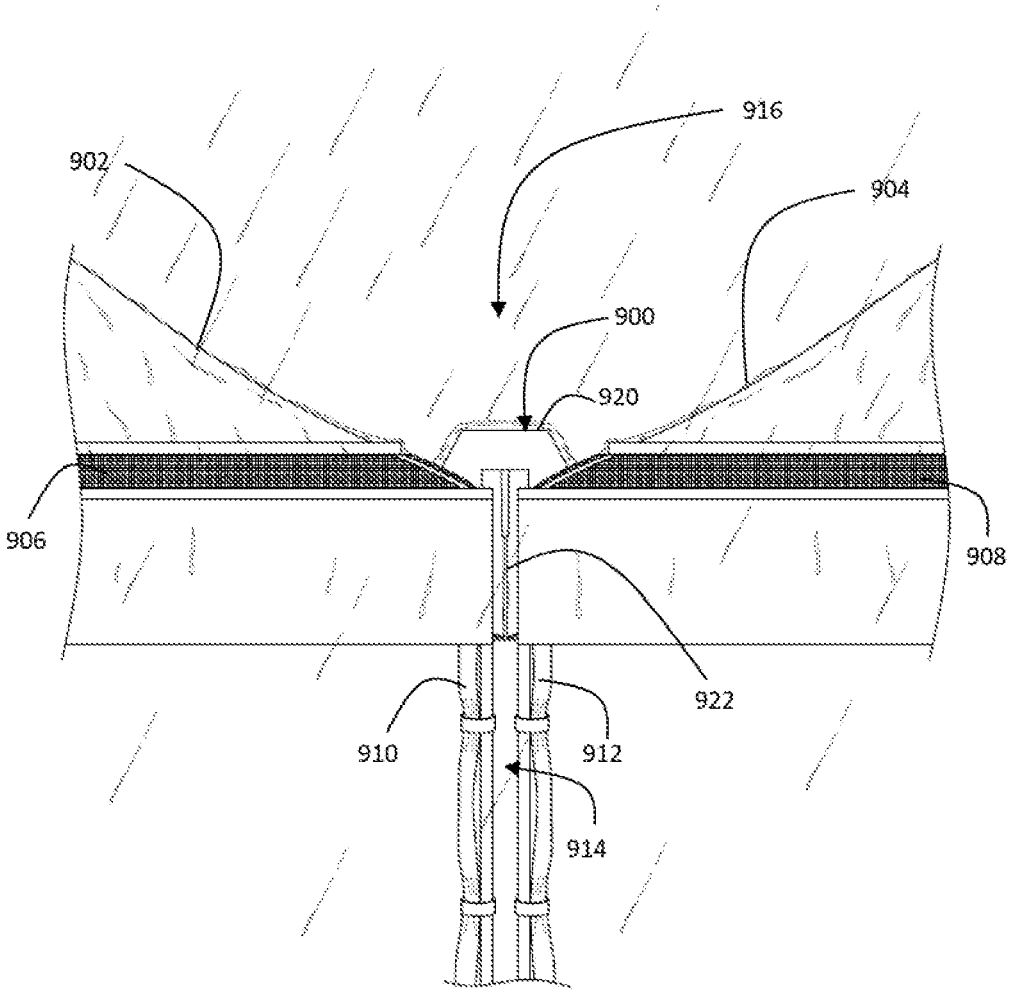
FIG. 9 illustrates an example canopy connector.

In one example, in order to facilitate the ability for the user to connect multiple canopies together in any customizable configuration to increase the overall canopy coverage area while preventing rain from falling down into gaps formed between canopies when they are combined, the gutter system includes a canopy connector 900, as illustrated in FIG. 9. The canopy connector 900 connects a first canopy 902 with a second canopy 904 and provides overall structure to the connected canopies 902 and 904. In addition, the canopy connector 900 provides a connection such that as rain falls down towards the middle area 916 in between the first canopy 902 and the second canopy 904, the canopy connector 900 will block the rain from entering a gap 914 in between the first canopy 902 and the second canopy 904. Instead, the canopy connector 900 will direct the falling rain towards one of the first or second rainwater collection slots 906 and 908 and into first or second spouts 910 and 912 of the first canopy 902 and second canopy 904, respectively.

The canopy connector 900 includes a center frame 922 for connecting two (2) adjacent canopies 902 and 904 and for providing the overall structure and integrity for different configurations of connecting canopies 902 and 904. The canopy connector 900 further includes gap cap 920, an interface that rest on top of the two adjacent canopies 902 and 904 and covers the space gap that exists between them. Gap cap 920 seals this gap and redirect rainwater so that it drains into the collection slots 906 and 908 of the gutter systems installed into the respective canopies 902 and 904.

Figure 10:
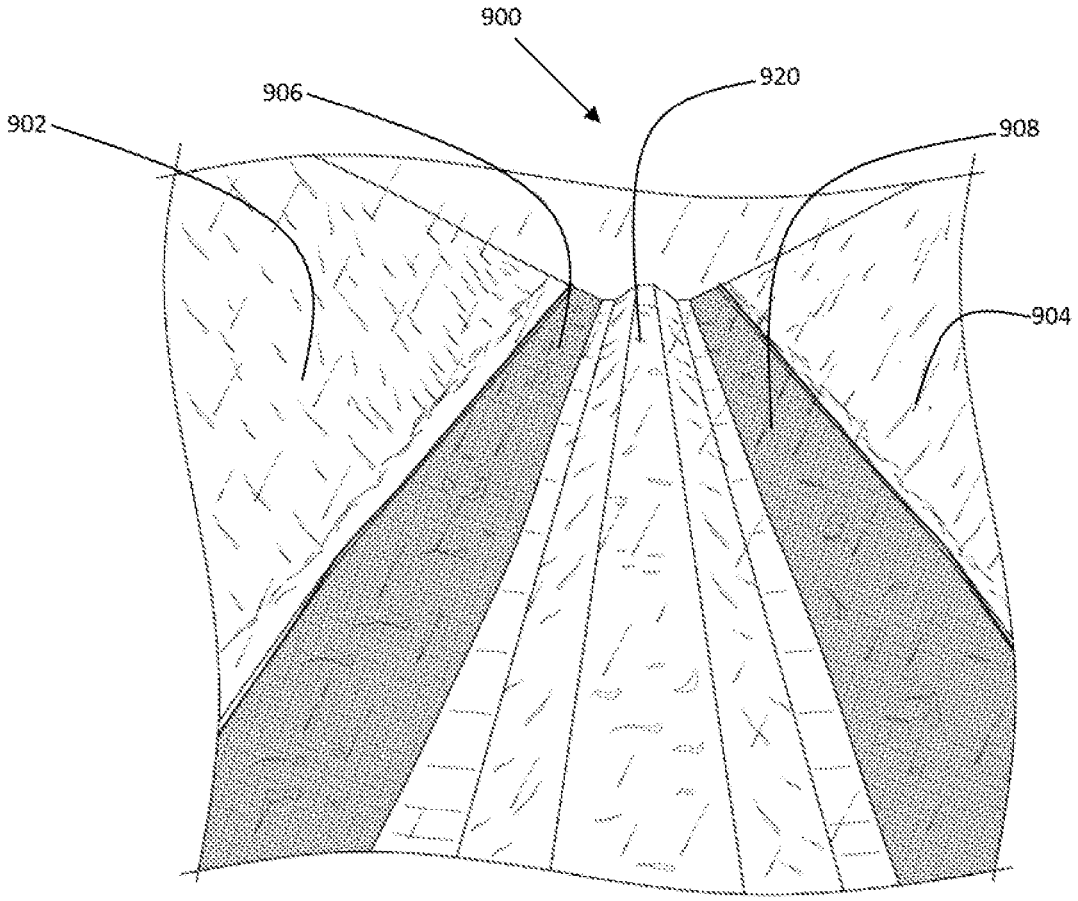
FIG. 10 illustrates an example canopy connector.

FIG. 10 illustrates a close-up view of the canopy connector 900. In one example, the gap cap 920 is designed in a triangle-like shape to create a peak, thus redirecting the rainwater that descends directly on top of it into the collection slots 906 and 908 of the gutter systems installed into the respective canopies 902 and 904.

It should be appreciated that the gap cap 920 does not drain water but rather act as an additional impediment to decrease the kinetic energy of the flowing rainwater and reduce its velocity so that the water is able to penetrate the collection slots 906 and 908 and get captured by the gutter systems of the respective canopies.

Figure 11:
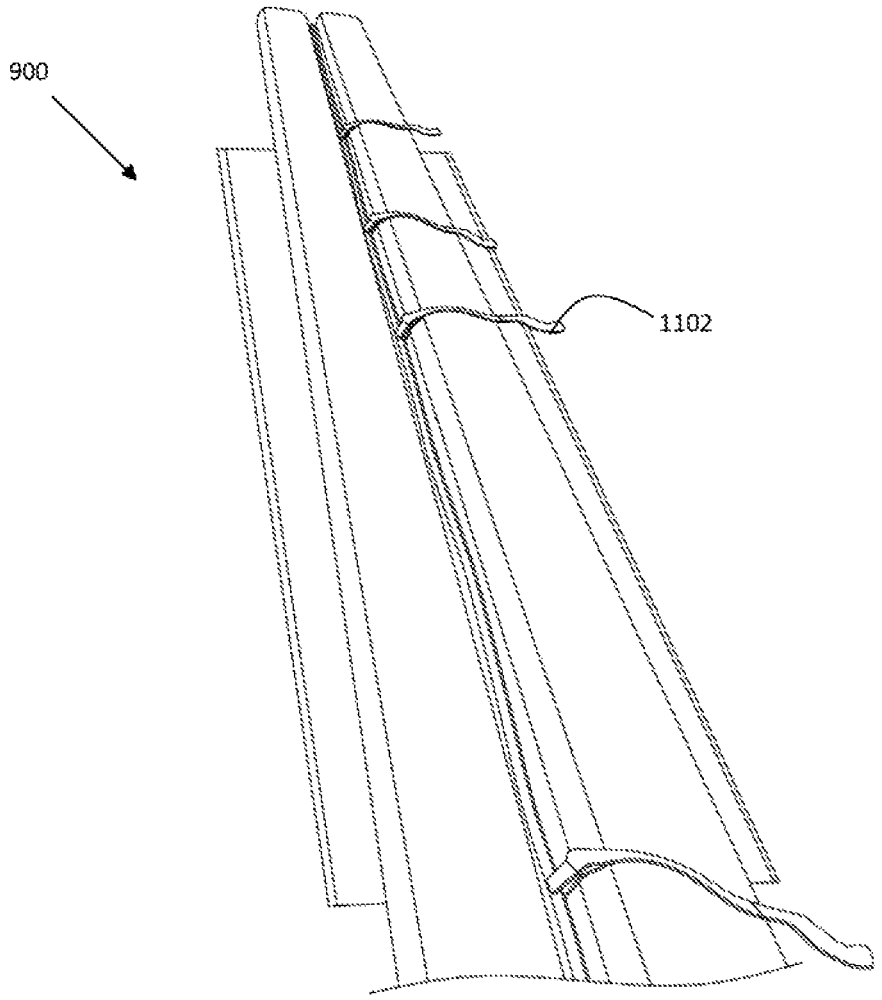
FIG. 11 illustrates an example canopy connector.
Figure 12:
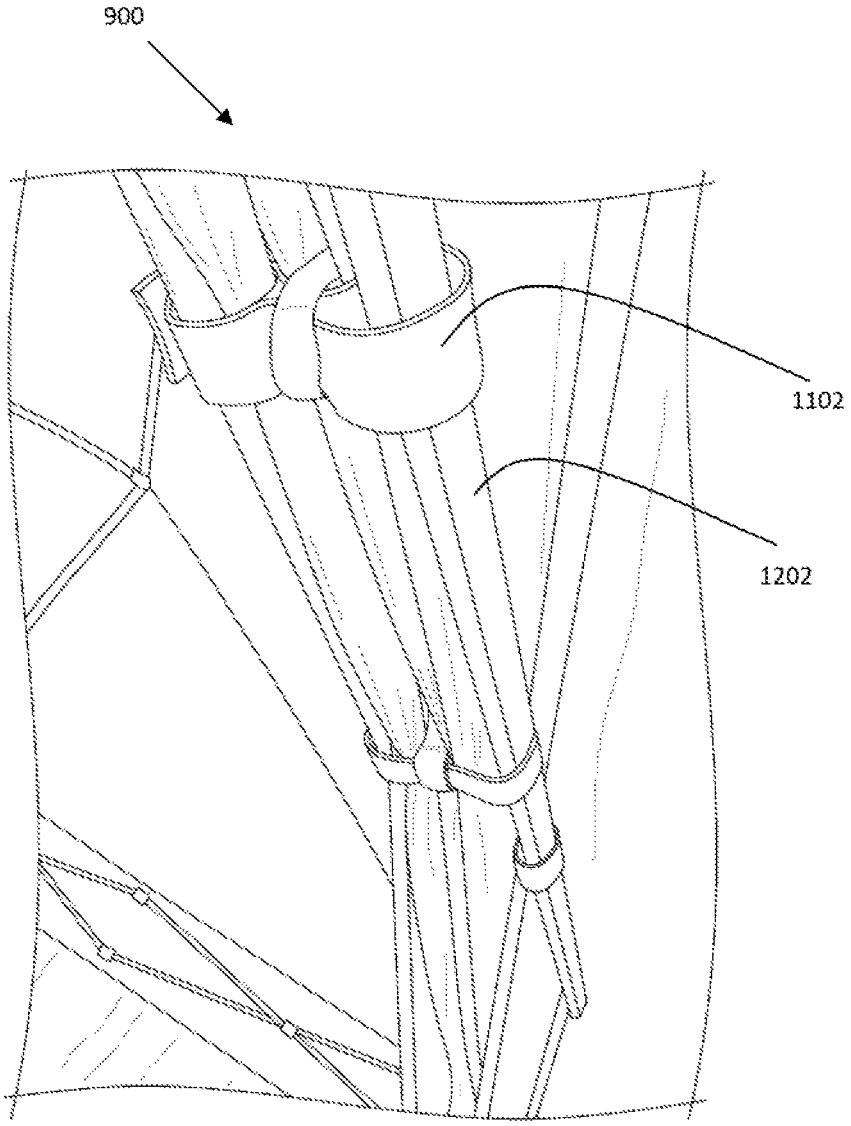
FIG. 12 illustrates an example canopy connector.

FIG. 11 illustrates the underside of the example canopy connector 900. The canopy connector 900 includes one (1) or more fasteners 1102 to hold the canopy connector 900 in place between the two (2) canopies 902 and 904. As illustrated in FIG. 12, the fasteners 1102 attach to the underside of the canopy connector 900 and connect to the frames 1202 of the adjoining canopies 902 and 904. In one example, the fastener 1102 is an elastic band. Elastic bands are used to maintain the connection between the canopy connector 900 and the frames 1202 in a constant state of tension so as to minimize the canopy connector 900 from moving.

In one example, the gap cap 920 works in conjunction with the storm block 502 and 504 (described in FIG. 5) to create and maintain the water seal between adjoining canopies 902 and 904. In particular, the storm blocks 502 and 504 reduce the kinetic energy of the flowing rainwater to the point the water does not possess the velocity to flow underneath the gap cap 920. The water has no choice but to penetrate and fall into the collection slots 906 and 908. The resulting effect is that water is not permitted to cascade between the gap 914 that exists between adjoining canopies.

It should be appreciated that the gap cap 920 is constructed in any suitable dimension. In one example, the ends of gap cap 920 are shaped such that 45-degrees slants are formed in order to facilitate multiple gap caps 920 merging at corners, when multiple canopies are arrange in various configurations.

It should be further appreciated that the gap cap 920 is constructed of any suitable material. In one example, the gap cap 920 is constructed of foam and enclosed in waterproof material. In one example, the canopy connector 900 runs the entire length of a gap existing between two adjoining canopies. In one example, the canopy connector 900 is foldable or can be taken apart into pieces for easy portability and storage.

To the extent that the term "includes" or "including" is used in the specification or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." When the applicants intend to indicate "only A or B but not both", then the term "only A or B but not both" will be employed. Thus, use of the term "or" herein is the inclusive, and not the exclusive use. See, Bryan A. Garner, A Dictionary of Modern Legal Usage 624 (2d. Ed. 1995). Also, to the extent that the terms "in" or "into" are used in the specification or the claims, it is intended to additionally mean "on" or "onto." Furthermore, to the extent the term "connect" is used in the specification or claims, it is intended to mean not only "directly connected to," but also "indirectly connected to" such as connected through another component or components.

While the present application has been illustrated by the description of embodiments thereof, and while the embodiments have been described in considerable detail, it is not the intention of the applicants to restrict or in any way limit the scope of the appended claims to such detail. Additional advantages and modifications will readily appear to those skilled in the art. Therefore, the application, in its broader aspects, is not limited to the specific details, the representative apparatus and method, and illustrative examples shown and described. Accordingly, departures may be made from such details without departing from the spirit or scope of the applicant's general inventive concept.

What is claimed:

1. A canopy gutter system, comprising:

a rainwater collection slot disposed on the top side of a canopy for collecting rainwater from the top side of the canopy, thereby preventing the rainwater from cascading over the sides of the canopy;

a rainwater gutter disposed underneath the rainwater collection slot for receiving the collected rainwater and channeling the collected rainwater away from a side of the canopy, toward a corner of the canopy;

a spout for transporting the channeled water from the rainwater gutter downward toward the ground along a leg of the canopy;

an outer storm block disposed along an outer edge of the rainwater collection slot; and an inner storm block disposed a distance inwards slightly offset from the outer storm block and along an inner edge of the rainwater collection slot;

wherein the inner and outer storm blocks collectively decelerate rainwater sliding down a rooftop of the canopy such that the velocity of the flowing rainwater does not exceed the requisite velocity to traverse past the rainwater collection slot, thereby further preventing rainwater from cascading over the sides of the canopy.

2. The canopy gutter system of claim 1, wherein the rainwater collection slot comprises mesh material for filtering and preventing debris from entering the rainwater gutter.

3. The canopy gutter system of claim 2, wherein the canopy gutter system comprises four rainwater collection slots, each disposed along one of four side edges of the canopy, and four rainwater gutters, each disposed underneath a respective rainwater collection slot.

4. The canopy gutter system of claim 3, wherein the canopy gutter system comprises four spouts, each disposed vertically along one of four legs of the canopy.

5. The canopy gutter system of claim 4, wherein a first half of a rainwater gutter is angled towards a first spout such that a portion of the collected water is directed towards the first spout, and wherein a second half of the rainwater gutter is angled towards a second spout such that a portion of the collected water is directed towards the second spout.

6. The canopy gutter system of claim 1, wherein a first half of the rainwater gutter is angled towards the spout, such that collected water is directed towards the spout.

7. The canopy gutter system of claim 1, further comprising a fastener securing the spout to the leg.

8. The canopy gutter system of claim 1, wherein the canopy gutter system is collapsible and foldable for transport and storage.

9. The canopy gutter system of claim 1, further comprising a canopy connector for connecting a first canopy with a second canopy wherein the canopy connector directs falling rain towards one of a first or second rainwater collection slot and into a first or second spout of the first canopy and second canopy, respectively, thereby preventing rain from falling down into a gap in between the first canopy and the second canopy.

10. The canopy gutter system of claim 9, the canopy connector further comprising a fastener for securing the canopy connector in place between the first canopy and the second canopy.

11. A canopy gutter system, comprising:

a rainwater collection slot disposed on the top side of a canopy for collecting rainwater from the top side of the canopy, thereby preventing the rainwater from cascading over the sides of the canopy;

a rainwater gutter disposed underneath the rainwater collection slot for receiving the collected rainwater and channeling the collected rainwater away from a side of the canopy, toward a corner of the canopy;

a spout for transporting the channeled water from the rainwater gutter downward toward the ground along a leg of the canopy; and a canopy connector for connecting a first canopy with a second canopy wherein the canopy connector directs falling rain towards one of a first or second rainwater collection slot and into a first or second spout of the first canopy and second canopy, respectively, thereby preventing rain from falling down into a gap in between the first canopy and the second canopy, the canopy connector including a gap cap disposed over the gap between the first canopy and the second canopy for preventing rainwater from entering into the gap between the first canopy and the second canopy, the gap cap comprising a triangle-like shape creating a peak over the gap to redirect rainwater into rainwater collection slots of the first and second canopies, respectively.

12. A canopy gutter system, comprising:

a rainwater collection slot disposed on the top side of a canopy for collecting rainwater from the top side of the canopy, thereby preventing the rainwater from cascading over the sides of the canopy;

a rainwater gutter disposed underneath the rainwater collection slot for receiving the collected rainwater and channeling the collected rainwater away from a side of the canopy, toward a corner of the canopy;

a spout for transporting the channeled water from the rainwater gutter downward toward the ground along a leg of the canopy; and a canopy connector for connecting a first canopy with a second canopy wherein the canopy connector directs falling rain towards one of a first or second rainwater collection slot and into a first or second spout of the first canopy and second canopy, respectively, thereby preventing rain from falling down into a gap in between the first canopy and the second canopy, the canopy connector including a fastener for securing the canopy connector in place between the first canopy and the second canopy, the fastener comprising an elastic band for maintaining the connection between the canopy connector and frames of the first and second canopies in a constant state of tension so as to minimize the canopy connector from moving.

* * * * *